US007565292B2

(12) United States Patent
Deng et al.

(10) Patent No.: US 7,565,292 B2
(45) **Date of Patent: *Jul. 21, 2009**

(54) QUANTITATIVE MODEL FOR FORMANT DYNAMICS AND CONTEXTUALLY ASSIMILATED REDUCTION IN FLUENT SPEECH

(75) Inventors: Li Deng, Sammamish, WA (US); Alejandro Acero, Bellevue, WA (US); Dong Yu, Kirkland, WA (US)

(73) Assignee: Micriosoft Corporation, Remond, WA (US)

( * ) Notice: Subject to any disclaimer, the term of this patent is extended or adjusted under 35 U.S.C. 154(b) by 1032 days.

This patent is subject to a terminal disclaimer.

(21) Appl. No.: 10/944,262

(22) Filed: Sep. 17, 2004

(65) Prior Publication Data

US 2006/0074676 A1 Apr. 6, 2006

(51) Int. Cl.
*G10L 13/00* (2006.01)

(52) U.S. Cl. ..... 704/260

(58) Field of Classification Search ..... 704/260
See application file for complete search history.

(56) References Cited

U.S. PATENT DOCUMENTS

| | | | | |
|---|---|---|---|---|
| 5,640,490 | A | 6/1997 | Hansen et al. | 704/254 |
| 5,666,466 | A | 9/1997 | Lin et al. | 704/246 |
| 6,182,037 | B1 | 1/2001 | Maes | 704/247 |
| 6,236,963 | B1 | 5/2001 | Naito et al. | 704/241 |
| 6,243,677 | B1 | 6/2001 | Arslan et al. | 704/244 |
| 6,442,519 | B1 | 8/2002 | Kanevesky et al. | 704/243 |
| 6,470,308 | B1 | 10/2002 | Ma et al. | 704/201 |
| 6,697,778 | B1 | 2/2004 | Kuhn et al. | 704/243 |
| 7,409,346 | B2 * | 8/2008 | Acero et al. | 704/254 |

OTHER PUBLICATIONS

B. Lindblom, "Spectrographic study of vowel reduction," J. Acoust. Soc. Am., vol. 35, 1963, pp. 1773-1781.

J. van Santen, "Contextual effects on vowel reduction," Speech Communication, vol. 11, 1992, pp. 513-546.

D. van Bergem, "Acoustic vowel reduction as a function of sentence accent, word stress and word class," Speech Communications, vol. 12, 1993, pp. 1-12.

S. Moon and B. Lindblom, "Interaction between duration, context, and speaking style in English stressed vowels," J. Acoust. Soc. Am., vol. 96, 1994, pp. 40-55.

M. Pitermann, "Effect of speaking rate and contrastive stress on formant dynamics and vowel perception," J. Acoust. Soc. Am., vol. 107, 2000, pp. 3425-3437.

S. Hertz, "Streams, phones, and transitions: Toward a new phonological and phonetic model of formant timing," J. Phonetics, vol. 19, 1991, pp. 91-109.

(Continued)

*Primary Examiner*—Susan McFadden
(74) *Attorney, Agent, or Firm*—Theodore M. Magee; Westman, Champlin & Kelly, P.A.

(57) ABSTRACT

A method of identifying a sequence of formant trajectory values is provided in which a sequence of target values are identified for a formant as step functions. The target values and the duration for each segment target for the formant are applied to a finite impulse response filter to form a sequence of formant trajectory values. The parameters of this filter, as well as the duration of the targets for each phone, can be modified to produce many kinds of target undershooting effects in a contextually assimilated manner. The procedure for producing the formant trajectory values does not require any acoustic data from speech.

18 Claims, 6 Drawing Sheets

OTHER PUBLICATIONS

J. Wouters and M. Macon, "Control of spectral dynamics in concatenative speech synthesis," IEEE Trans. Speech and Audio Proc., vol. 9, 2001, pp. 30-38.
L. Deng, "Computational models for speech production," in Computational Models of Speech Pattern Processing, (K. Ponting Ed.), Berlin: Springer, 1999, pp. 199-213.
J. Ma and L. Deng, "Efficient decoding strategies for conversational speech recognition using a constrained nonlinear state-space model for vocal-tract-resonance dynamics," IEEE Trans. Speech and Audio Proc., vol. 11, 2003, pp. 590-602.
J. Ma and L. Deng, "Target-directed mixture dynamic models for spontaneous speech recognition," IEEE, Trans. Speech and Audio Proc., vol. 12, 2004, pp. 47-58.
Deng, Li et al., Speech Processing—*A Dynamic and Optimization-Oriented Approach*, chapter 13, Marcel Dekker Inc., New York, NY, 2003.
Deng et al., L., "A structured Speech Model with Continuous Hidden Dynamics and Prediction-Residual Training for Tracking Vocal Tract Resonances," IEEE Proc. ICASSP, vol. I, pp. 557-560, May 2004.
Deng et al., L., "A Quantitative Model for Formant Dynamics and Contextually Assimilated Reduction in Fluent Speech", ICSLP 2004, Jeju, Korea, 2004.
Eide et al., E., "A Parametric Approach to Vocal Tract Length Normalization," IEEE Proc. ICASSP, pp. 346-348, 1996.
Lee, et al., L., "A Frequency Warping Approach to Speaker Normalization," IEEE Transactions on Speech and Audio Processing, vol. 6, No. 1, pp. 49-60, Jan. 1998.
Wang et al., W., "The Use of a Linguistically Motivated Language Model in Conversational Speech Recognition," IEEE Proceedings of International Conference on Acoustics, Speech and Signal Proceedings, vol. 1, pp. 261-264, May 2004.
Welling et al., L., "A Study on Speaker Normalization Using Vocal Tract Normalization and Speaker Adaptive Training", IEEE Proceedings of ICASSP, vol. 2, pp. 797-800, May 1998.
Zhan et al., P., "Speaker Normalization Based on Frequency Warping," IEEE Proceedings of ICASSP, pp. 1039-1042, 1997.
Zhan et al., P., "Vocal Tract Length Normalization for Large Vocabulary Continuous Speech Recognition", CMU-CS-97-148, Carnegie Mellon University, Pittsburgh, PA, May 1997.
Zhou et al., J., "Coarticulation Modeling by Embedding a Target-Directed Hidden Trajectory Model into HMM," IEEE Proceedings of ICASSP, vol. I, pp. 744-747, Apr. 2003.
U.S. Appl. No. 11/069,474, filed Mar. 1, 2005 entitled "Two-Stage Implementation for Phonetic Recognition Using a Bi-Direction Target-Filtering Model of Speech Coarticulation and Reduction".
U.S. Appl. No. 11/071,904, filed Mar. 1, 2005 entitled "Acoustic Models with Structured Hidden Dynamics with Integration Over Many Possible Hidden Trajectories".
U.S. Appl. No. 10/944,262, filed Sep. 17, 2004 entitled "Quantitative Model for Formant Dynamics and Contextually Assimilated Reduction in Fluent Speech".
Klatt, D. H., "Software for a cascade/parallel formant synthesizer", Journal of the Acoustical Society of America, vol. 67, No. 3, pp. 971-995, Mar. 1980.
Lindblom, B., "Explaining Phonetic Variation: A Sketch of the H & H Theory", Speech Production and Speech Modelling, Kluwer Academic Publishers, pp. 403-439, 1990.
Holmes et al., W. J., "Probabilistic-trajectory segmental HMMs", Computer Speech and Language, vol. 13, pp. 3-37, 1999.
Lindblom, B., "Spectrographic Study of Vowel Reduction," The Journal of the Acoustical Society of America, vol. 35, No. 11, pp. 1773-1781, Nov. 1963.
Zweig, G., "Bayesian network structures and inference techniques for automatic speech recognition", Computer Speech and Language, vol. 17, pp. 173-193, 2003.
Bilmes, J. "Buried Markov models: a graphical-modeling approach to automatic speech recognition", Computer Speech and Language, vol. 17, pp. 213-231, 2003.
Siu et al., M., "Parametric Trajectory Mixtures for LVCSR", 5$^{th}$ International Conference on Spoken Language Processing, Sydney, Australia, pp. 3269-3272, 1998.
Wegmann et al., S., "Speaker Normalization on Conversational Telephone Speech", IEEE International Conference on Acoustics, Speech, and Signal Processing Conference Proceedings, pp. 339-341, May 1996.
Ma et al., J., "A mixed-level switching dynamic system for continuous speech recognition", Computer Speech and Language, vol. 18, pp. 49-65, 2004.
Pols, L C. W., "Psycho-acoustics and Speech Perception", Computational Models of Speech Pattern Processing, Springer-Verlag Berlin Heidelberg, pp. 10-17, 1999.
Rose et al., R. C., "The potential role of speech production models in automatic speech recognition", Journal of the Acoustical Society of America, vol. 99, No. 3, pp. 1699-1709, Mar. 1996.
Stevens, K. N., "On the quantal nature of speech", Journal of Phonetics, vol. 17, 1989.
Digalakis et al., V., "Rapid Speech Recognizer Adaptation to New Speakers", John Hopkins University, Oct. 1998.
Deng et al., L., "A Bi-Directional Target-Filtering Model of Speech Coarticulation and Reduction: Two-Stage Implementation for Phonetic Recognition", IEEE Transactions of Speech and Audio Processing, Jun. 2004.
Deng, et al., L., "Tracking Vocal Tract Resonances Using a Quantized Nonlinear Function Embedded in a Temporal Constraint," IEEE Transactions on Speech and Audio Processing, Mar. 2004.
Hajic et al., J., "Core Natural Language Processing Technology Applicable to Multiple Languages", Final Report for Center for Language and Speech Processing, John Hopkins University, 1998.
Deng, L. "A dynamic, feature-based approach to the interface between phonology and phonetics for speech modeling and recognition," Speech Communication, vol. 24, No. 4, pp. 299-323, Mar. 1998.
Ostendorf et al., M., "From HMM's to Segment Models: A Unified View of Stochastic Modeling for Speech Recognition" IEEE Transactions on Speech and Audio Processing, vol. 4, No. 5, pp. 360-378, Sep. 1996.
Bridle et al., J. S., "An Investigation of Segmental Hidden Dynamic Models of Speech Coarticulation for Automatic Speech Recognition," Final Report of a Project at the 1998 Workshop on Language Engineering, Center for Language and Speech Processing, John Hopkins University, pp. 1-61, 1998.
Sun et al., J., "An Overlapping-Feature Based Phonological Model Incorporating Linguistic Constraints: Applications to Speech Recognition," Journal of the Acoustic Society of America, vol. 111, No. 2, pp. 1086-1101, Feb. 2002.
Bilmes, J., "Graphical Models and Automatic Speech Recognition", Mathematical Foundations of Speech and Language Processing, Springer-Verlag New York, Inc., pp. 191-245, 2004.
Chelba et al., C., "Structured language modeling", Computer Speech and Language, vol. 14, pp. 283-332, Oct. 2000.
Deng, L., "A generalized hidden Markov model with state-conditioned trend functions of time for the speech signal", Signal Processing, vol. 27, pp. 65-78, 1992.
Deng, L., "Switching Dynamic System Models for Speech Articulation and Acoustics", Mathematical Foundations of Speech and Language Processing, Springer-Verlag New York, Inc., pp. 115-134, 2004.
Deng et al., L., "Context-dependent Markov model structured by locus equations: Applications to phonetic classification", The Journal of the Acoustical Society of America, vol. 96, No. 4, pp. 2008-2025, Oct. 1994.
Ficus, J. G., "A Post-Processing System to Yield Reduced Word Error Rates: Recognizer Output Voting Error Reduction", 1997 IEEE Workshop on Automatic Speech Recognition and Understanding Proceedings, pp. 347-354, 1997.
Gao et al., Y., "Multistage Coarticulation Model Combining Articulatory, Formant and Cepstral Features", Proceedings of the ICSLP, vol. 1, pp. 25-28, 2000.
Gay, T. "Effect of speaking rate on vowel formant movements", The Journal of the Acoustical Society of America, vol. 63, No. 1, pp. 223-230, Jan. 1978.
Kamm et al., T., "Vocal tract normalization in speech recognition: Compensating for systematic speaker variability", The Journal of the Acoustical Society of America, vol. 97, No. 5, Pt. 2, pp. 3246-3247, May 1995.

* cited by examiner

QUANTITATIVE MODEL FOR FORMANT DYNAMICS AND CONTEXTUALLY ASSIMILATED REDUCTION IN FLUENT SPEECH

BACKGROUND OF THE INVENTION

The present invention relates to models of speech. In particular, the present invention relates to formant models of fluent speech.

Human speech contains spectral promanances or formants. These formants carry a significant amount of the information contained in human speech.

In the past, attempts have been made to model the formants associated with particular phonetic units, such as phonemes, using discrete state models such as a Hidden Markov Model. Such models have been less than ideal, however, because they do not perform well when the speaking rate increases or the articulation of the speaker decreases.

Research into the behavior of formants during speech indicates that one possible reason for the failure of HMM based formant systems in handling fluent speech is that during fluent speech the formant values for different classes of phonetic units become very similar as the speaking rate increases or the articulation effort decreases.

Although this phenomenon, known as reduction, has been observed in human speech, an adequate model for predicting such behavior in formant tracks has not been developed. As such, a model is needed that predicts the observed dynamic patterns of the formants based on the interaction between phonetic context, speaking rate, and speaking style.

SUMMARY OF THE INVENTION

A method of identifying a sequence of formant trajectory values is provided in which a sequence of target values of formant frequencies and bandwidths are established first, which may or may not be reached by actual formants in the trajectories. The target values for the formant are applied to a finite impulse response filter to form a sequence of formant trajectory values.

DETAILED DESCRIPTION OF ILLUSTRATIVE EMBODIMENTS

Figure 1:
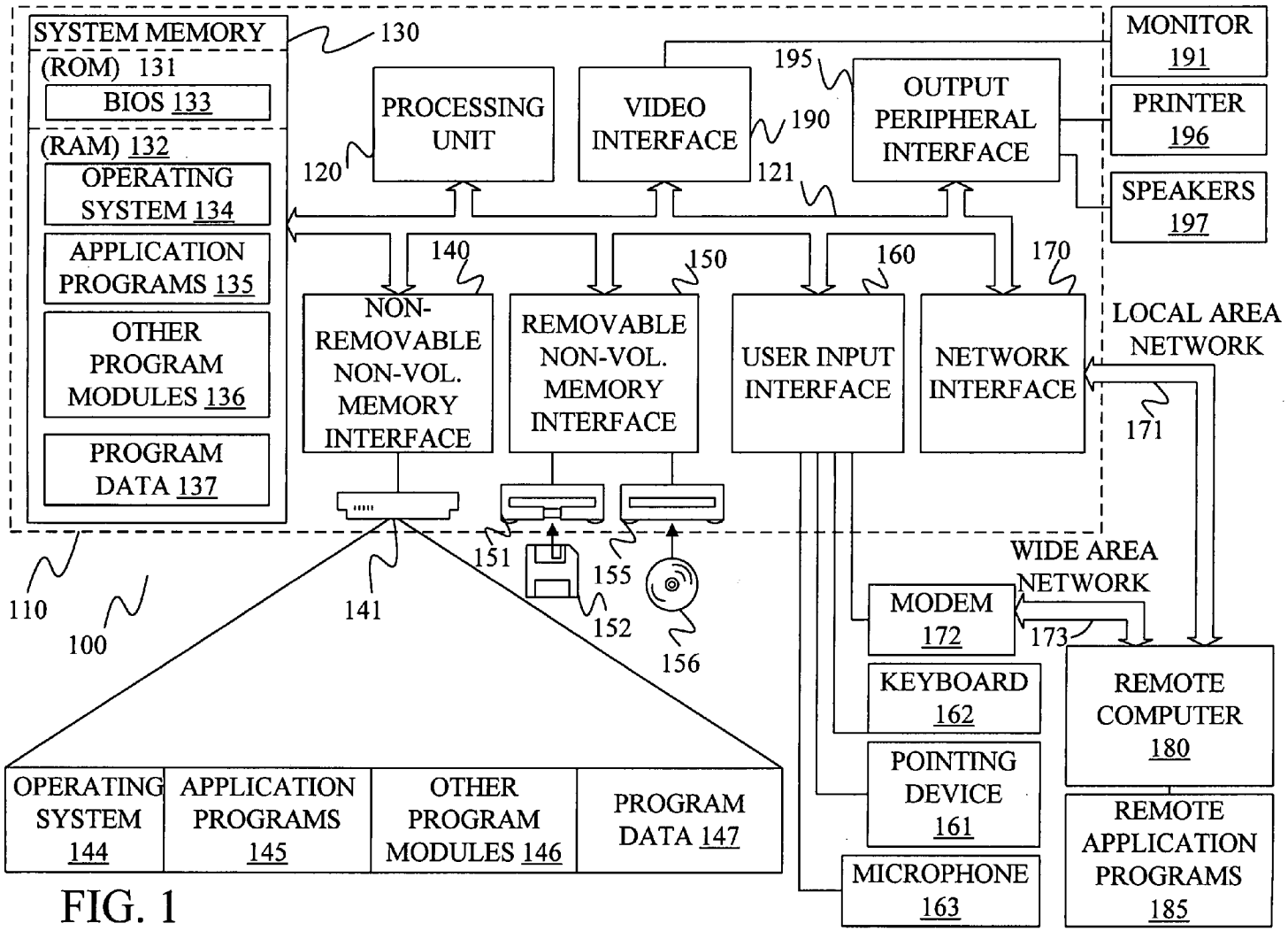
FIG. 1 is a block diagram of one computing environment in which the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention is designed to be practiced in distributed computing environments where tasks are performed by remote processing devices that are linked through a communications network. In a distributed computing environment, program modules are located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 is operated in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
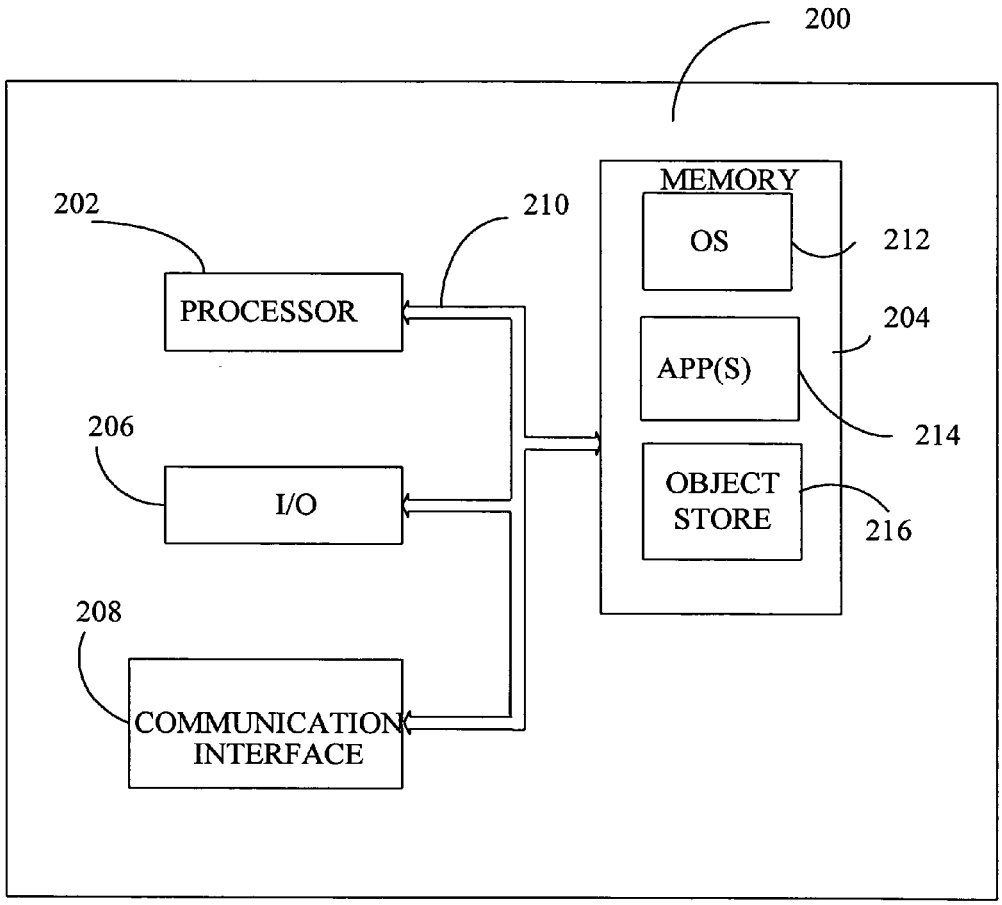
FIG. 2 is a block diagram of an alternative computing environment in which the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

In the past, the failure of Hidden Markov Models to perform well on speech signals with high speaking rates or with low speaking effort has often been attributed to a lack of training data for these types of speech. The present inventors, however, have discovered that it is likely that even with more training data for these types of speech, Hidden Markov Models will still not be able to recognize speech with the desired amount of accuracy. The reason for this is that at high speaking rates the formant patterns for different vowel sounds begin to converge if only discrete portions of the speech signal are examined when making a recognition decision.

Figure 3:
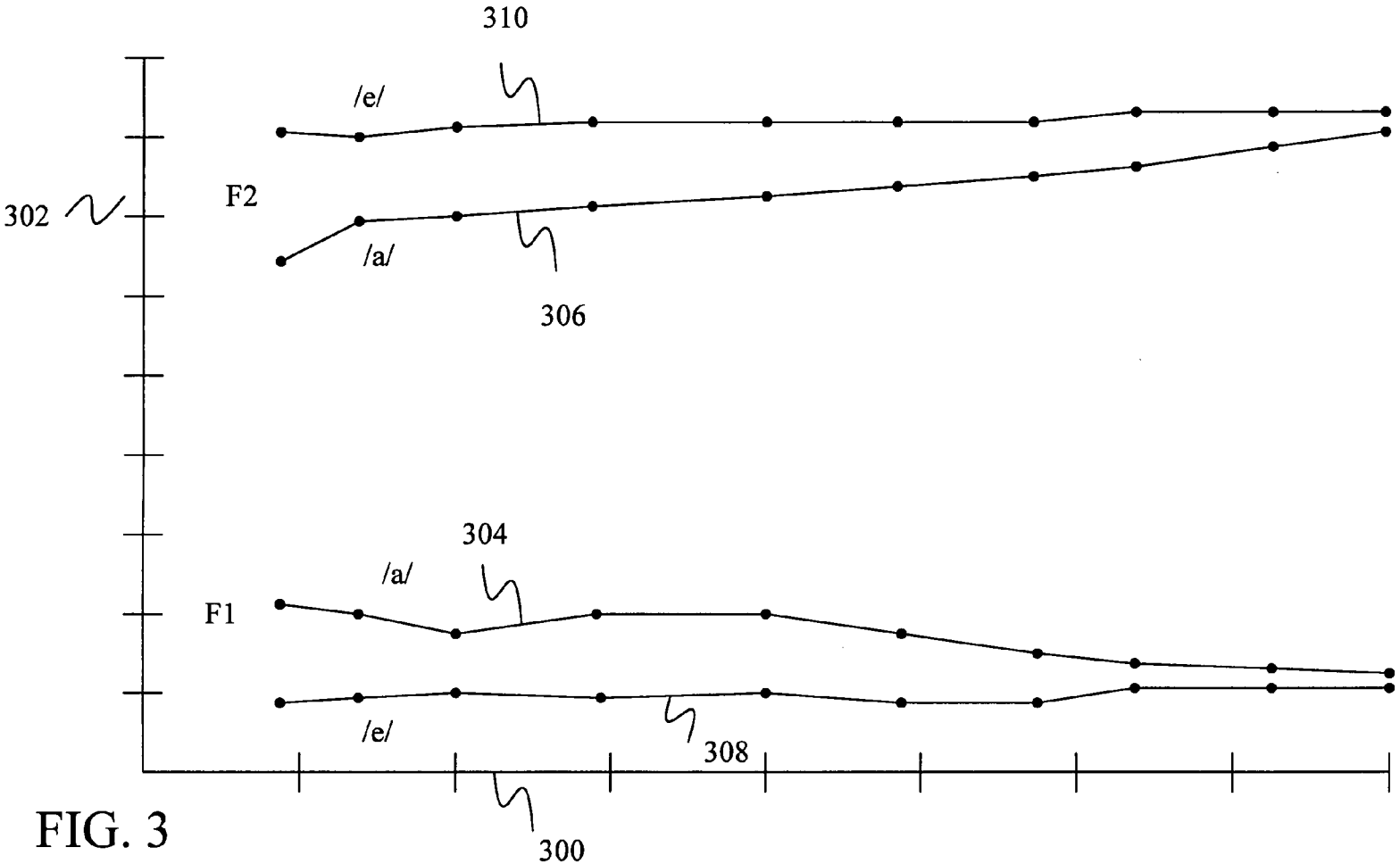
FIG. 3 provides a graph of observed formant values for two different vowel sounds as speaking rate increases.

This convergence of the formant values for different vowel sounds is referred to as static confusion. FIG. 3 provides a diagram showing that as the speaking rate increases, formants for two different vowel sounds begin to converge. In particular, in FIG. 3, the speaking rate is shown on horizontal axis 300 and the frequency of the first and second formants is shown on vertical axis 302. In FIG. 3 speaking rate increases from left to right and frequency increases from the bottom to the top. The value of the first formant and the second formant for the vowel sound /a/ are shown by lines 304 and 306, respectively. The values of the first and second formant for the vowel sound /e/ are shown by lines 308 and 310, respectively.

As can be seen in FIG. 3, the first and second formants for the vowel sounds /a/ and /e/ are much more separated at lower speaking rates than at higher speaking rates. Because of this, at higher speaking rates, it is more difficult for the speech recognition system to distinguish between the /a/ sound and the /e/ sound.

The present invention provides a model for formants, which accurately predicts the static confusion represented by the data of FIG. 3. This model is a result of an interaction between phonetic context, speaking rate/duration, and spectral rate of changes related to the speaking style.

Under the model, a sequence of formant targets, modeled as step functions, are passed through a finite impulse response (FIR) filter to produce a smooth continuous formant pattern.

The FIR filter is characterized by the following non-causal impulse response function:

$$h_s(k)\begin{cases} C\gamma_{s(k)}^{-k} & -D<k<0 \\ C & k=0 \\ C\gamma_{s(k)}^{k} & 0<k<D \end{cases} \qquad \text{EQ. 1}$$

where k represents the center of a time frame, typically with a length of 10 milliseconds, $\gamma_{s(k)}$ is a stiffness parameter, which is positive and real valued, ranging between zero and one. The s(k) in $\gamma_{s(k)}$ indicates that the stiffness parameter is dependent on the segment state s(k) on a moment-by-moment and time varying basis, and D is the unidirectional length of the impulse response.

In equation 1, k=0 represents a current time point, k less than zero represents past time points, and k greater than zero represents future time points.

Thus, in the impulse response of Equation 1, it is assumed for simplicity that the impulse response is symmetric such that the extent of coarticulation in the forward direction is equal to the extent of coarticulation in the backward direction. In other words, the impulse response is symmetric with respect to past time points and future time points. In other embodiments, the impulse response is not symmetrical. In particular, for languages other than English, it is sometimes beneficial to have a nonsymmetrical impulse response for the FIR filter.

In Equation 1, C is a normalization constraint that is used to ensure that the sum of the filter weights adds up to one. This is essential for the model to produce target "undershoot," instead of "overshoot." To compute C, it is first assumed that the stiffness parameter stays approximately constant across the temporal span of the finite impulse response such that:

$$\gamma_{s(k)} \approx \gamma \qquad \text{EQ. 2}$$

Under this assumption, the value of C can be determined for a particular γ as:

$$C \approx \frac{1-\gamma}{1+\gamma-2\gamma^{D+1}} \qquad \text{EQ. 3}$$

Under the model of the present invention, the target for the formants is modeled as a sequence of step-wise functions with variable durations and heights, which can be defined as:

$$T(k) = \sum_{i=1}^{P} [u(k-k_{s_i}^{l}) - u(k-k_{s_i}^{r})] x T_{si}, \qquad \text{EQ. 4}$$

where u(k) is the unit step function that has a value of zero when its argument is negative and one when its argument is positive, $k_s^r$ is the right boundary for a segment s and $k_s^l$ is the left boundary for the segment s, $T_s$ is the target for the segment s and P is the total number of segments in the sequence.

Figure 4:
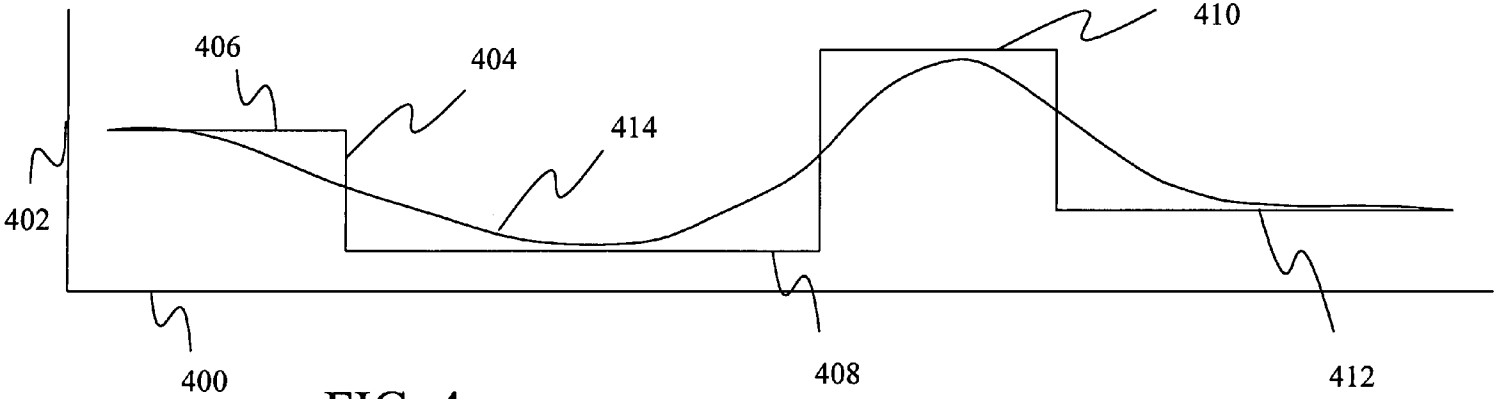
FIG. 4 provides a graph of a target sequence for a formant a predicted formant trajectory using the formant model of the present invention.

FIG. 4 provides a graph of a target sequence 404 that can be described by Equation 4. In FIG. 4, time is shown on horizontal axis 400 and frequency is shown on vertical axis 402. In FIG. 4 there are four segments having four targets 406, 408, 410 and 412.

The boundaries for the segments must be known in order to generate the target sequence. This information can be determined using a recognizer's forced alignment results or can be learned automatically using algorithms such as those described in J. Ma and L. Deng, "Efficient Decoding Strategies for Conversational Speech Recognition Using a Constrained Non-Linear State Space Model for Vocal-Tract-Resonance Dynamics," IEEE Transactions on Speech and Audio Processing, Volume 11, 203, pages 590-602.

Given the FIR filter and the target sequence, the formant trajectories can be determined by convolving the filter response with the target sequence. This produces a formant trajectory of:

$$g_s(k) = h_{s(k)} * T(k) = \sum_{\tau=k-D}^{k+D} C(\gamma_{s(\tau)}) T_{s(\tau)} \gamma_{s(\tau)}^{|k-\tau|}, \qquad \text{EQ. 5}$$

where Equation 5 gives a value of the trajectory at a single value of k. In Equation 5, the stiffness parameter and the normalization constant C, are dependent on the segment at time τ. Under one embodiment of the present invention, each segment is given the same stiffness parameter and normalization constant. Even under such an embodiment, however, each segment would have its own target value $T_{s(\tau)}$.

The individual values for the trajectory of the formant can be sequentially concatenated together using:

$$g(k) = \sum_{i=1}^{P} [u(k - k_{s_i}^{l}) - u(k - k_{s_i}^{r})] \cdot g_{s_i}(k) \quad \text{EQ. 6}$$

Note that a separate computation of Equation 6 is performed for each formant frequency resulting in separate formant trajectories.

The parameters of the filter, as well as the duration of the targets for each phone, can be modified to produce many kinds of target undershooting effects in a contextually assimilated manner.

FIG. 4 shows a predicted formant trajectory 414 developed under the model of the present invention using an FIR filter and target sequence 404 of FIG. 4. As shown in FIG. 4, the formant trajectory is a continuous trajectory that moves toward the target of each segment. For longer length segments, the formant trajectory comes closer to the target than for shorter segments.

Figure 5:
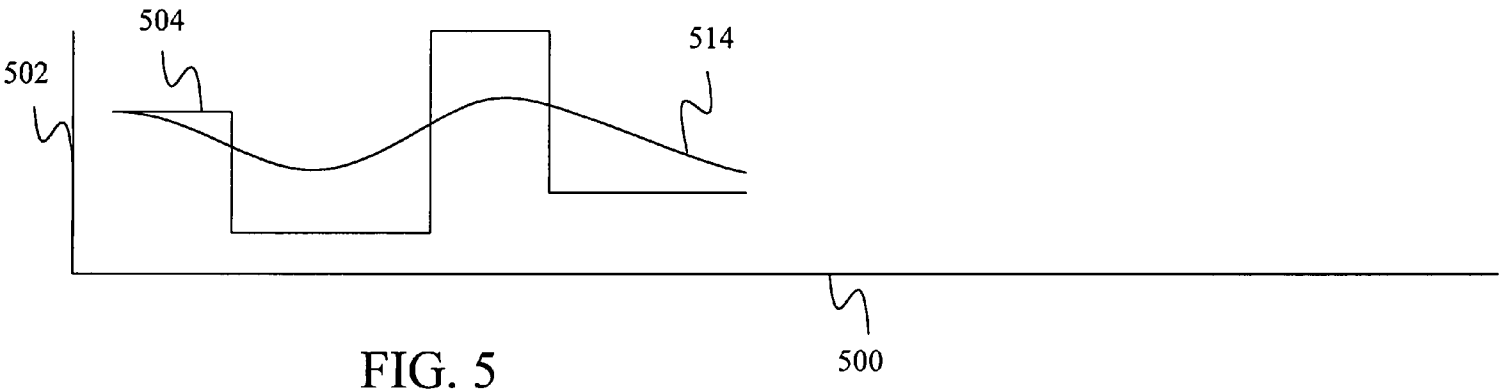
FIG. 5 provides a graph of a target sequence with shorter durations than FIG. 4 and a corresponding predicted formant trajectory using the formant model of the present invention.

FIG. 5 shows a graph of a target sequence and a resulting predicated formant trajectory using the present model, in which the same segments of FIG. 4 are present, but have a much shorter duration. Thus, the same targets are in target sequence 504 as in target sequence 404, but each has a shorter duration. As with FIG. 4, in FIG. 5, time is shown along horizontal axis 500 and frequency is shown along vertical axis 502.

Because of the shorter duration of each segment, the predicted formant trajectories do not come as close to the target values in FIG. 5 as they did in FIG. 4. Thus, as the duration of a speech segment shortens, there is an increase in the reduction of the formant trajectories predicted by the present model. This agrees well with the observed reductions in formant trajectories as speech segments shorten.

Figure 6:
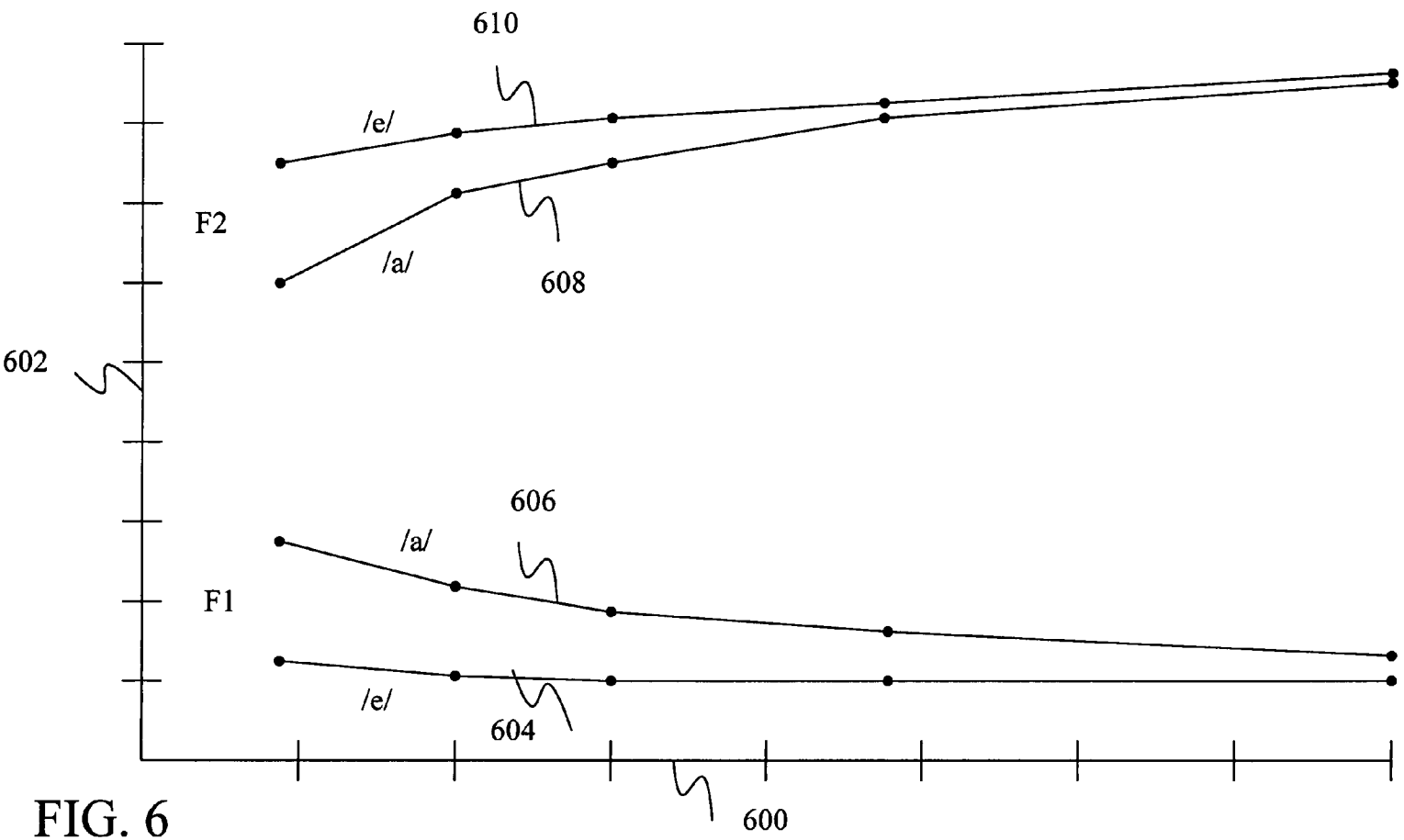
FIG. 6 provides a graph of predicted formant values using the model of the present invention as speaking rate increases.

The predicted formant trajectories under the present invention also predict the static confusion between phonemes that is found in the observation data of FIG. 3. In particular, as shown in FIG. 6, the FIR filter model of the present invention predicts that as speaking rates increase the values of the first and second formants for two different phonetic units will begin to approach each other. As in FIG. 3, in FIG. 6, speaking rate is shown along horizontal axis 600 and formant frequency values are shown along vertical axis 602.

In FIG. 6, lines 604 and 610 show the values predicted by the model of the present invention for the first and second formants, respectively, of the phonetic unit /e/ as a function of speaking rate. Lines 606 and 608 show the values predicted by the model for the first and second formants, respectively, of the phonetic unit /a/.

As shown by FIG. 6, the predicted values for the first and second formants of phonetic units /e/ and /a/ converge towards each other as the speaking rate increases. Thus, the FIR filter model of the present invention generates formant trajectories that agree well with the observed data and that suggest that static confusion between phonetic units is caused by convergence of the formant values as speaking rates increase.

Figure 7:
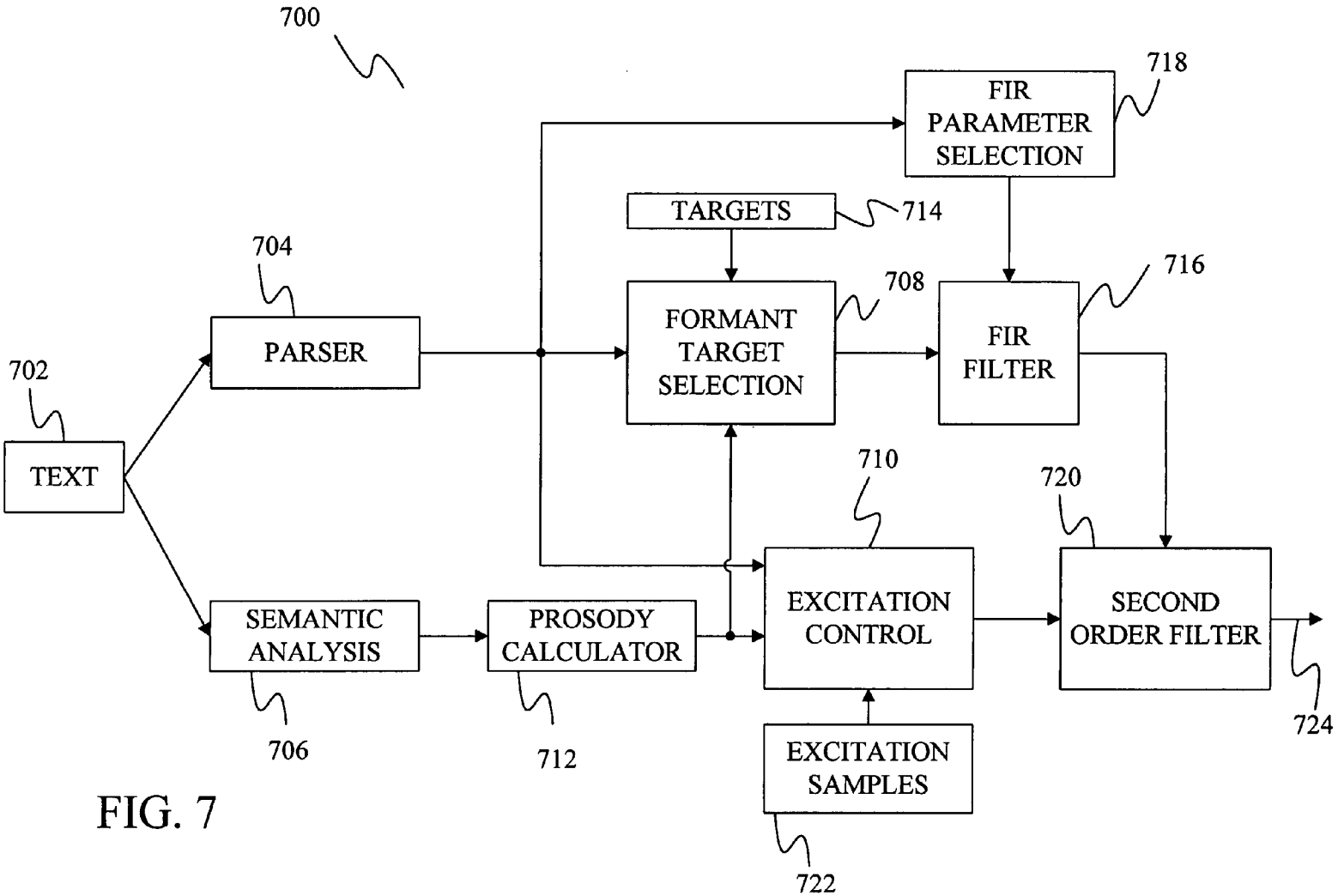
FIG. 7 is a block diagram of a speech synthesis system in which the present invention may be practiced.

The formant trajectory model of the present invention may be used in a speech synthesis system such as speech synthesizer 700 of FIG. 7. In FIG. 7, a text 702 is provided to a parser 704 and a semantic analysis component 706. Parser 704 parses the text into phonetic units that are provided to a formant target selection unit 708 and an excitation control 710. Semantic analysis component 706 identifies semantic features of text 702 and provides these features to a prosody calculator 712. Prosody calculator 712 identifies the duration, pitch, and loudness of different portions of text 702 based on the semantic identifiers provided by semantic analysis 706. Typically, the result of prosody calculator 712 is a set of prosody marks that are provided to excitation control 710 and formant target selection 708.

Using the prosody marks, which indicate the duration of different sounds, and the identities of the phonetic units provided by parser 704, formant target selection 708 generates a target sequence using a set of predefined targets 714. Typically, there is a separate set of targets 714 for each phonetic unit that can be produced by parser 704, where each set targets includes a separate target for each of four formants.

The output of formant target selection 708 is a sequence of targets similar to target sequence 404 of FIG. 4, which is provided to a finite impulse response filter 716. The impulse response of finite impulse response filter 716 is defined according to Equation 1 above. Under some embodiments, the response is dependent on the particular phonetic units identified by parser 704. In such cases, the response of the filter is set by an FIR parameter selection unit 718, which selects the parameters from a set of stored finite impulse response parameters based on the phonetic units identified by parser 704.

The output of FIR filter 716 is a set of formant trajectories, which in one embodiment includes trajectories for four separate formants. These formant trajectories are provided to a second order filter 720.

Excitation control 710 uses the phonetic units from parser 704 and the prosody marks from prosody calculator 712 to generate an excitation signal, which, in one embodiment, is formed by concatenating excitation samples from a set of excitation samples 722. The excitation signal produced by excitation control 710 is passed through second order filter 720, which filters the excitation signal based on the formant trajectories identified by FIR filter 716. This results in synthesized speech 724.

Although the present invention has been described with reference to particular embodiments, workers skilled in the art will recognize that changes may be made in form and detail without departing from the spirit and scope of the invention.

What is claimed is:

1. A method comprising:

receiving a text;

parsing the text into a sequence of phonetic units;

identifying a sequence of target values for a formant based on the sequence of phonetic units;

applying the sequence of target values to a finite impulse response filter to produce a sequence of formant values; and using the sequence of formant values to generate synthesized speech.

2. The method of claim 1 wherein applying the sequence of target values to a finite impulse response filter comprises applying the sequence of target values to a finite impulse response filter that generates a value based on past target values and future target values.

3. The method of claim 2 wherein the finite impulse response is symmetrical with respect to past target values relative to future target values.

4. The method of claim 1 wherein identifying a sequence of target values comprises identifying a separate target value for each phonetic unit in the sequence of phonetic units.

5. The method of claim 1 wherein identifying a sequence of target values further comprises determining a duration for each target value in the sequence of target values.

6. The method of claim 1 wherein the response of the finite impulse response filter produces undershoot in the sequence of formant values relative to the sequence of target values.

7. A computer-readable storage medium having computer-executable instructions that when executed by a processor cause the processor to perform steps comprising:

parsing a text to identify a sequence of phonetic units;

identifying a sequence of target formant values from the sequence of phonetic units;

at a point in the sequence of target formant values, determining a formant trajectory value using multiple target formant values that occur before the point in the sequence of target formant values and using multiple target formant values that occur after the point in the sequence of target formant values; and using the formant trajectory value to form a synthesized speech signal.

8. The computer-readable storage medium of claim 7 wherein determining a formant trajectory value comprises applying the sequence of target formant values to a finite impulse response filter.

9. The computer-readable storage medium of claim 8 wherein the response of the finite impulse response filter is dependent on a phonetic unit associated with a target formant value.

10. The computer-readable storage medium of claim 8 wherein the finite impulse response filter uses the same number of target formant values that occur before the point as the number of target formant values that occur after the point.

11. The computer-readable storage medium of claim 10 wherein the response of the finite impulse response filter is symmetrical.

12. The computer-readable storage medium of claim 7 wherein identifying a sequence of phonetic units further comprises identifying a duration for each phonetic unit.

13. The computer-readable storage medium of claim 7 further comprising determining a sequence of formant trajectory values.

14. The computer-readable storage medium of claim 13 wherein the sequence of target formant trajectory values is based in part on a rate of speech and the sequence of formant trajectory values exhibits formant reduction with changes in the rate of speech.

15. A method of synthesizing speech, the method comprising:

identifying a sequence of phonetic units;

identifying a sequence of target formant values from the sequence of phonetic units;

applying the sequence of target formant values to a finite impulse response filter to form a sequence of formant trajectory values;

using the sequence of formant trajectory values to control a filter; and applying an excitation signal to the filter to form a speech signal.

16. The method of claim 15 wherein the finite impulse response filter uses past target formant values and future target formant values to form a current formant trajectory value.

17. The method of claim 16 wherein the finite impulse response filter is symmetrical with respect to the past target formant values and the future target formant values.

18. The method of claim 16 wherein the response of the finite impulse response filter changes depending on the phonetic unit associated with the trajectory formant value.

* * * * *